US007095173B2

(12) United States Patent
Kwon et al.

(10) Patent No.: US 7,095,173 B2
(45) Date of Patent: Aug. 22, 2006

(54) PLASMA DISPLAY PANEL HAVING DISCHARGING PORTIONS WITH INCREASING AREAS

(75) Inventors: Jae-Ik Kwon, Asan-si (KR); Kyoung-Doo Kang, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/876,484

(22) Filed: Jun. 28, 2004

(65) Prior Publication Data

US 2005/0029944 A1 Feb. 10, 2005

(30) Foreign Application Priority Data

Jun. 28, 2003 (KR) ..... 10-2003-0042898

(51) Int. Cl.
*H01J 17/49* (2006.01)
*G09G 3/10* (2006.01)

(52) U.S. Cl. ..... 313/583; 313/584; 313/585; 345/41; 345/43

(58) Field of Classification Search ..... 313/581–585, 313/586, 609; 315/167, 169.1, 169.4; 345/41, 345/43, 55
See application file for complete search history.

(56) References Cited

U.S. PATENT DOCUMENTS 5,587,624 A * 12/1996 Komaki ..... 313/584
6,031,329 A * 2/2000 Nagano ..... 313/582
6,075,504 A * 6/2000 Stoller ..... 345/60
6,566,812 B1 5/2003 Torisaki et al. ..... 313/586
6,700,323 B1 * 3/2004 Amemiya ..... 313/582
6,714,175 B1 * 3/2004 Shimada et al. ..... 314/60
6,720,736 B1 * 4/2004 Lee et al. ..... 315/169.3
2003/0001501 A1 * 1/2003 Amemiya ..... 313/582
2003/0090212 A1 * 5/2003 Park et al. ..... 315/169.1
2004/0232843 A1 * 11/2004 Kim et al. ..... 313/586
2005/0062418 A1 * 3/2005 Kang et al. ..... 313/582

FOREIGN PATENT DOCUMENTS

KR 2003-0047016 6/2003

* cited by examiner

*Primary Examiner*—Joseph Williams
*Assistant Examiner*—Peter Macchiarolo
(74) *Attorney, Agent, or Firm*—H.C. Park & Associates, PLC

(57) ABSTRACT

A plasma display panel provides increased brightness over an entire screen while simultaneously reducing power consumption. The plasma display panel includes a rear substrate, a plurality of address electrodes disposed parallel to each other on the rear substrate, a first dielectric layer covering the address electrodes, light emitting cells defined by a barrier rib formed on the first dielectric layer and covered with fluorescent substance, a front substrate, a plurality of sustain electrode pairs, each of which includes a scan electrode and a data electrode and disposed on the front substrate and intersecting the address electrodes, and a second dielectric layer covering the sustain electrode pairs. The parts of the address electrodes which intersect the address electrodes are defined as discharging portions, and areas of subsequent discharging portions are larger than areas of preceding discharging portions.

15 Claims, 5 Drawing Sheets

PLASMA DISPLAY PANEL HAVING DISCHARGING PORTIONS WITH INCREASING AREAS

CROSS-REFERENCE TO RELATED APPLICATIONS

This application claims priority of Korean Patent Application No. 2003-42898, filed on Jun. 28, 2003, in the Korean Intellectual Property Office, the disclosure of which is hereby incorporated by reference in its entirety.

BACKGROUND OF THE INVENTION

1. Field of the Invention

The present invention relates to a plasma display panel, and more particularly, to a plasma display panel providing increased brightness over the entire screen while simultaneously reducing power consumption.

2. Description of the Related Art

FIG. 1 illustrates a plasma display panel 8 similar to one disclosed in U.S. Pat. No. 6,566,812, which is hereby incorporated by reference. The plasma display panel 8 includes a rear substrate 10, address electrodes 20 disposed on the rear substrate in parallel, a first dielectric layer 30 covering the address electrodes 20, a barrier rib 40 disposed on the dielectric layer 30 with a grid shape to define a light emitting cell 50, a front substrate 60, sustain electrode pairs 70 formed on a lower surface of the front substrate 60, a second dielectric layer 80 covering the sustain electrode pairs 70, and an MgO layer 90 covering the second dielectric layer 80. The MgO layer 90 improves durability of the second dielectric layer 80, and is not essential for operation. The plasma display panel 8 is manufactured by adhering the front substrate 60 to the rear substrate 10. A discharging gas (not shown) is provided in the light emitting cell 50 when the front substrate to and the rear substrates 10 are joined together, and a fluorescent substance is formed on the lateral surface of barrier rib 40 and the upper surface of the first dielectric layer 30. Ultraviolet rays irradiate from the discharging gas due to the discharge between the electrodes, and the ultraviolet rays excite the fluorescent substance. The energy level of the fluorescent substance, now excited, is lowered by generating visible light rays.

FIG. 2 is a plan view of the plasma display panel shown in FIG. 1, wherein various layers of the plasma display panel are illustrated in shadow. The light emitting cell 50 is disposed above the address electrode 20, and a sustain electrode pair 70, including a data electrode ($X_1$, $X_2$, . . . , or $X_n$) and a scan electrode ($Y_1$, $Y_2$, . . . , or $Y_n$), is disposed above the light emitting cell 50. Address discharging occurs between the scan electrode ($Y_1$, $Y_2$, . . . , or $Y_n$) and a discharging portion ($R_1$, $R_2$, . . . , or $R_n$) of the address electrode 20 crossing the scan electrode ($Y_1$, $Y_2$, . . . , or $Y_n$) In order for the discharging to occur, a sufficient amount of positive ions gather on the upper surface of the first dielectric layer 30 by the operation of address electrode 20, immediately before the address discharging occurs. Thus, the scan electrodes ($Y_1$, $Y_2$, . . . , or $Y_n$) and the address electrodes 20 are reset immediately before address discharging occurs, so that the positive ions gather on the upper surface of the first dielectric layer 30.

As shown in FIG. 2, each of the discharging portions $R_1$, $R_2$, . . . , and $R_n$ of the address electrodes 20 in the conventional plasma display panel 8 has the same area. When the areas of the discharging portions $R_1$, $R_2$, . . . , and $R_n$ of the address electrodes 20 are equal and the discharging area is excessively large, power consumption increases greatly. On the other hand, if the discharging area is too small, the brightness of light emitted from a light emitting cell is not high enough where a subsequent scan electrode $Y_s$ and a subsequent discharging portion $R_s$ are disposed; however, the brightness of light emitted from a light emitting cell is high enough where a preceding scan electrode $Y_p$ and a preceding discharging portion $R_p$ are disposed.

Moreover, the brightness of light emitted from a light emitting cell is degraded where the subsequent discharging portion $R_s$ is disposed because address signals are sequentially applied to the scan electrodes $Y_1$, $Y_2$, . . . , $Y_n$. That is, while address discharging occurs between the preceding scan electrode $Y_p$ and a preceding discharging portion $R_p$ due to a transmission of the address signal to the preceding scan electrode $Y_p$, the subsequent scan electrode $Y_s$ and a subsequent discharging portion $R_s$ are in a discharged state after reset. In this discharged state, positive ions gathered above the subsequent discharging portion $R_s$ combine with electrodes, and thus, the amount of positive ions above the subsequent discharging portion $R_s$ is not enough for address discharging to occur when address discharging should occur above the subsequent discharging portion $R_s$. Therefore, address discharging between the subsequent scan electrode $Y_s$ and the subsequent discharging portion $R_s$ is degraded.

SUMMARY OF THE INVENTION

The present invention provides a plasma display panel having increased high brightness over an entire display screen while simultaneously reducing power consumption. The present invention provides a plasma display panel including a rear substrate, a plurality of address electrodes disposed parallel to each other on the rear substrate, a first dielectric layer covering the address electrodes, light emitting cells that are defined by a barrier rib formed on the first dielectric layer and covered with fluorescent substance, a front substrate, a plurality of sustain electrode pairs, each of which includes a scan electrode and a data electrode and disposed on the front substrate and intersecting the address electrodes and a second dielectric layer covering the sustain electrode pairs. Parts of the address electrodes that intersect the address electrodes are defined as discharging portions and areas of subsequent discharging portions are larger than areas of preceding discharging portions.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

A plasma display panel configured in accordance to an exemplary embodiment of the present invention will now be described with reference to FIG. 3.

Figure 1:
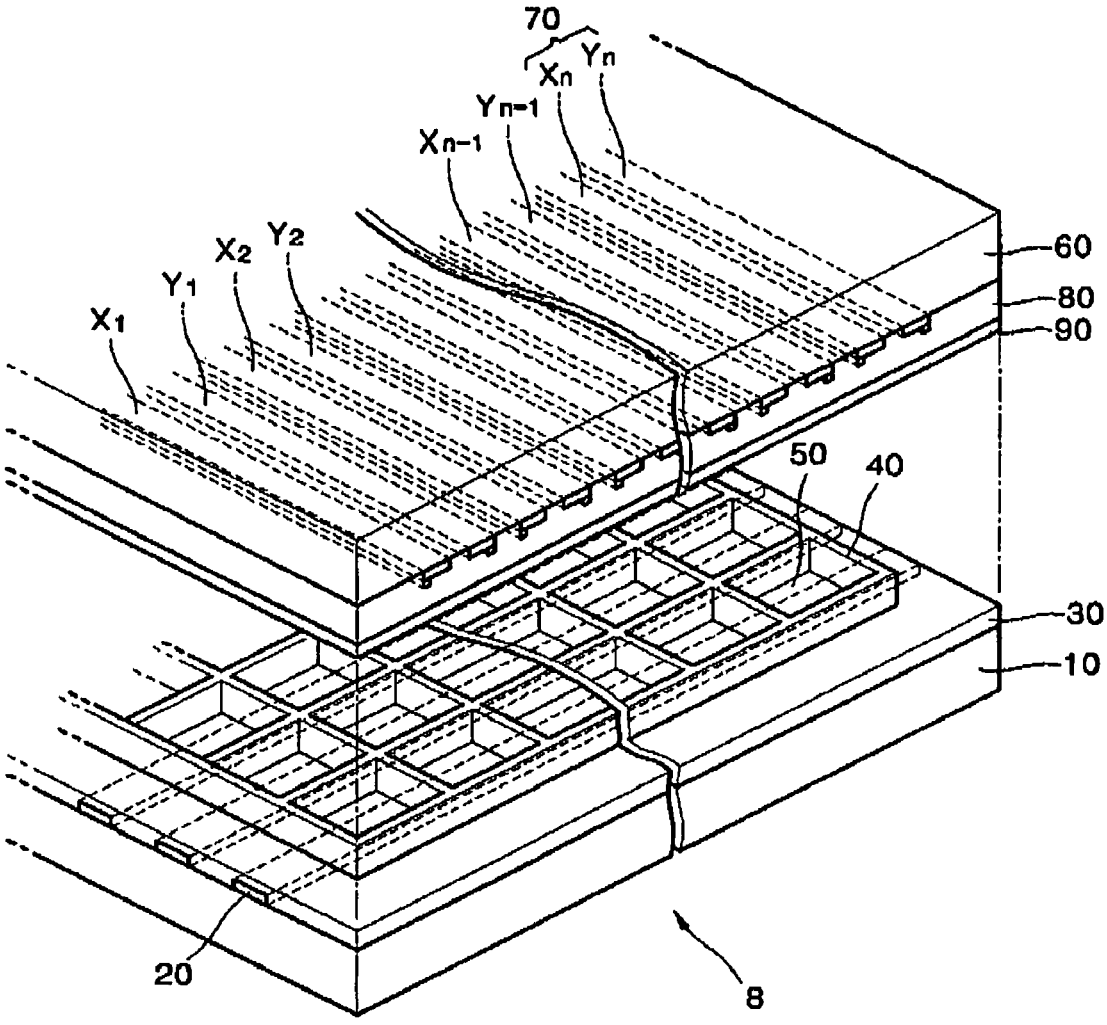
FIG. 1 (PRIOR ART)
FIG. 1 is a perspective view of a conventional plasma display panel, wherein various layers of the plasma display panel are illustrated in shadow.
Figure 2:
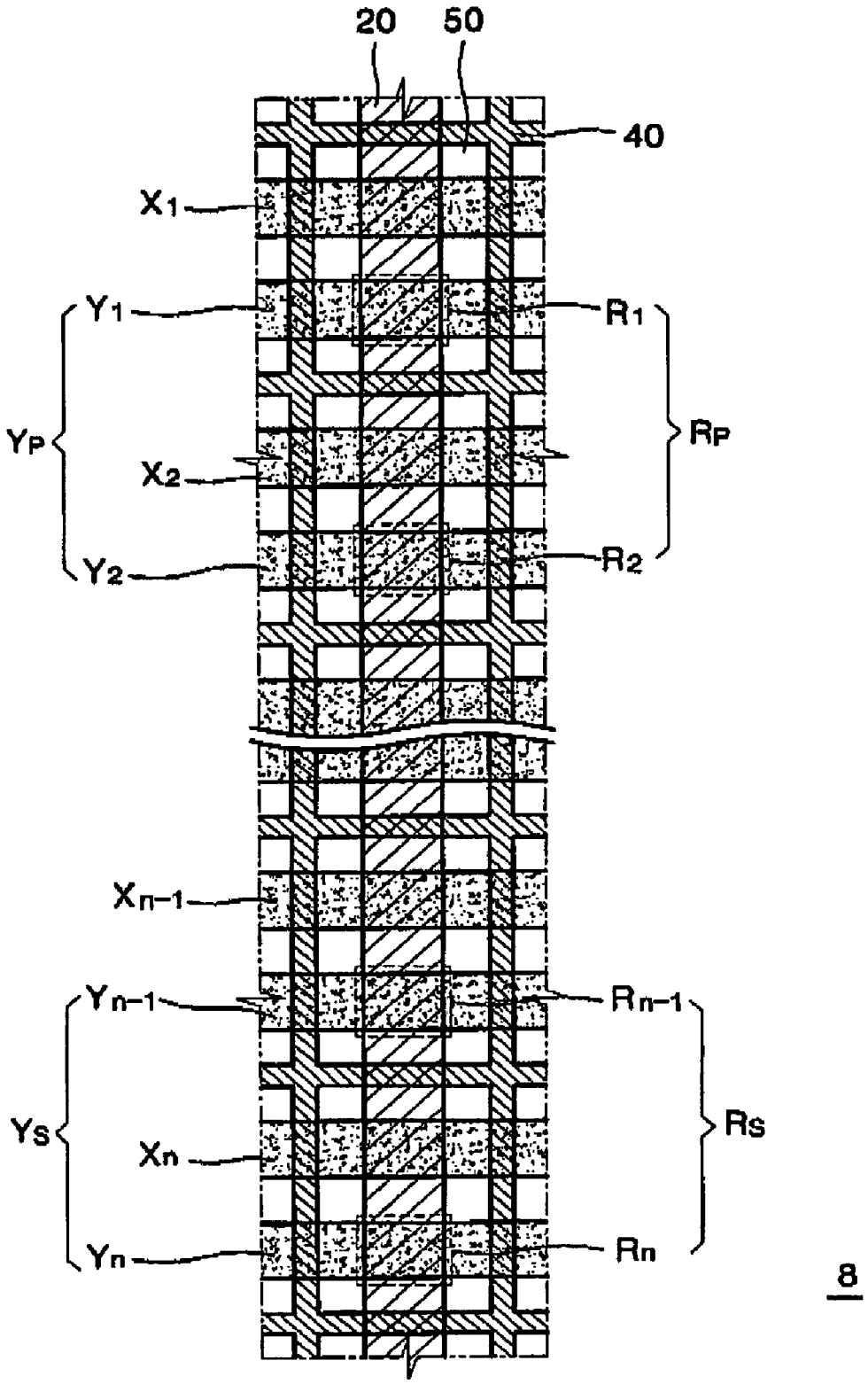
FIG. 2 (PRIOR ART)
FIG. 2 is a plan view of the conventional plasma display panel shown in FIG. 1, wherein various layers of the plasma display panel are illustrated in shadow.
Figure 3:
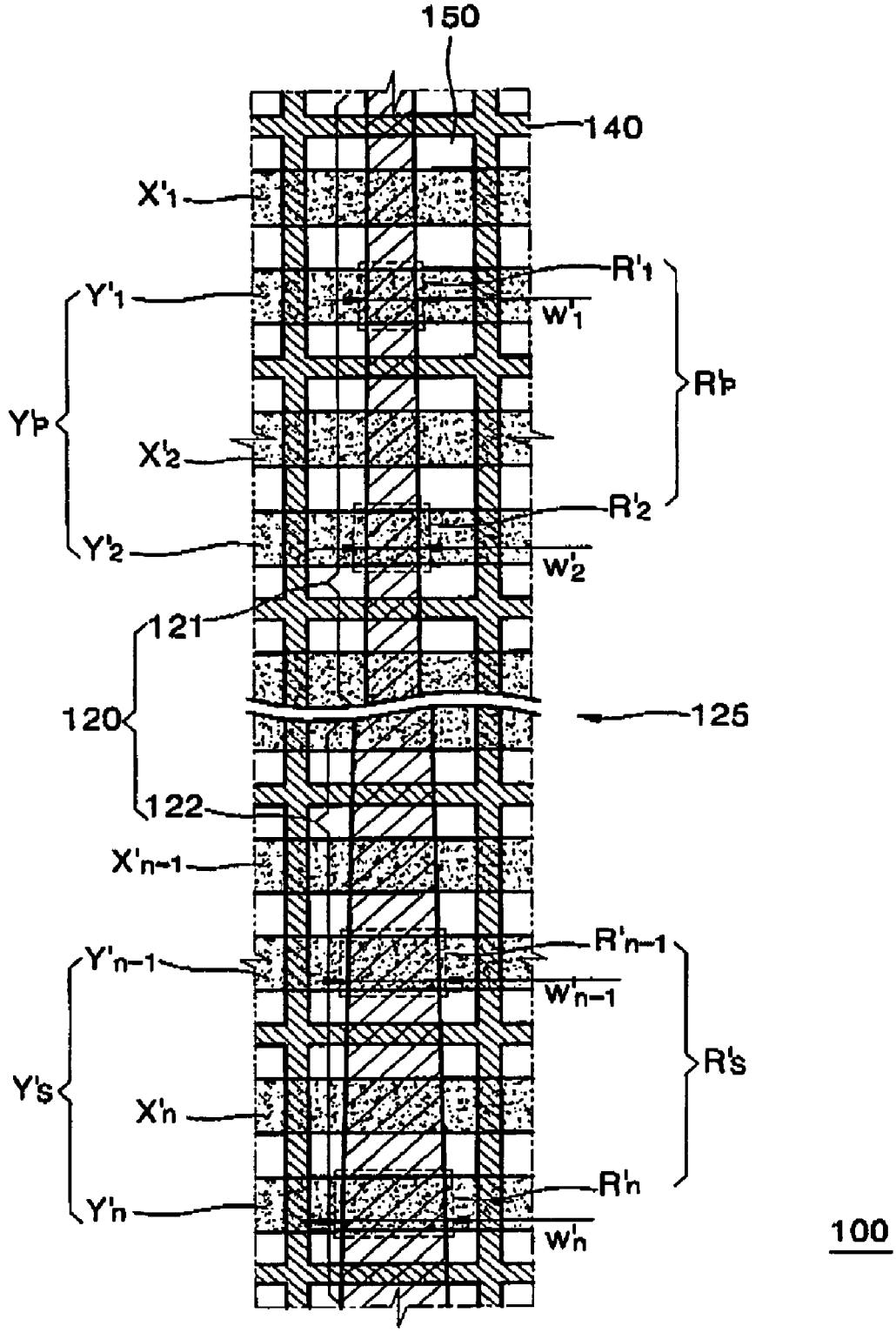
FIG. 3 is a plan view of a plasma display panel configured in accordance with a preferred first embodiment of the present invention, wherein various layers of the plasma display panel are illustrated in shadow.

FIG. 3 illustrates a plasma display panel 100 having a shape of an address electrode 120, while other elements of the plasma display panel 100 of the present invention are similar to those of the conventional plasma display panel 8. That is, the plasma display panel 100 includes a rear substrate, a plurality of address electrodes disposed parallel to each other on the rear substrate, a first dielectric layer covering the address electrodes, light emitting cells that are defined by a barrier rib formed on the first dielectric layer and coated with a fluorescent substance therein, a front substrate, a plurality of sustain electrode pairs disposed perpendicular to the address electrodes on the front substrate, and a second dielectric layer covering the sustain electrode pairs.

The address electrode 120 in FIG. 3 includes a preceding portion 121, where discharging occurs earlier, and a subsequent portion 122, where address discharging occurs later. The preceding portion 121 and the subsequent portion 122 can be divided by a certain point or a certain region (intermediate portion) 125 on the address electrode 120. For example, one half of the address electrode 120 may be the preceding portion 121, and the other half of the address electrode 120 may be the subsequent portion 122. However, the address electrode 120 is not necessarily divided into two halves, but may be divided into the preceding portion 121 and the subsequent portion 122 at any point along the address electrode 120.

The preceding portion 121 includes a preceding discharging portion $R'_p$ located below preceding scan electrodes $Y'_p$ to which address signals are transmitted earlier. The subsequent portion 122 includes a subsequent discharging portion $R'_s$ located below the subsequent scan electrodes $Y'_s$ to which the address signals are transmitted later.

As shown in FIG. 3, a width of the address electrode 120 increases from the preceding portion 121 to the subsequent portion 122. Therefore, widths w1', w2', . . . , $w'_{n-1}$, $w'_n$ of discharging portions $R'_1$, $R'_2$, . . . , $R'_{n-1}$, $R'_n$ sequentially increase, and areas of the subsequent discharging portions are larger than areas of the preceding discharging portions. As shown in FIG. 3, since widths of the scan electrodes $Y'_1$, $Y'_2$, . . . , $Y'_{n-1}$, $Y'_n$ crossing the address electrode 120 are all equal, areas where the discharging occur (areas formed by crossing the scan electrodes and the address electrodes 120) increase from the preceding portion 121 toward the subsequent portion 122. Although the width of the address electrode 120 is shown as increasing linearly and gradually, the width of the address electrode 120 may increase discontinuously as a step function.

Since the widths w'1, w'2, . . . , $w'_{n-1}$, $w'_n$ of the discharging portions $R'_1$, $R'_2$, . . . , $R'_{n-1}$, $R'_n$ gradually increase, more positive ions gather above the subsequent discharging portions $R'_s$ than above the preceding discharging portions $R'_p$ right after resetting. Therefore, even if some of the positive ions escape from the subsequent discharging portions $R'_s$ while the address discharging occurs in the preceding discharging portions $R'_p$, a sufficient amount of positive ions remain in the subsequent discharging portions $R'_s$, and the address discharging occurs under good conditions in the subsequent discharging portions $R'_s$.

On the other hand, the widths $w'_1$, $w'_2$, . . . of the preceding discharging portions should be wide enough for the address discharging to occur, and should be narrower than the widths . . . , $w'_{n-1}$, $w'_n$ of the subsequent discharging portions. Therefore, unnecessary power consumption that occurs when the widths of the preceding discharging portions are wide as those of the subsequent discharging portions is prevented.

A plasma display panel 200 according to another embodiment of the present invention will now be described mainly in view of differences from the previous embodiment.

Figure 4:
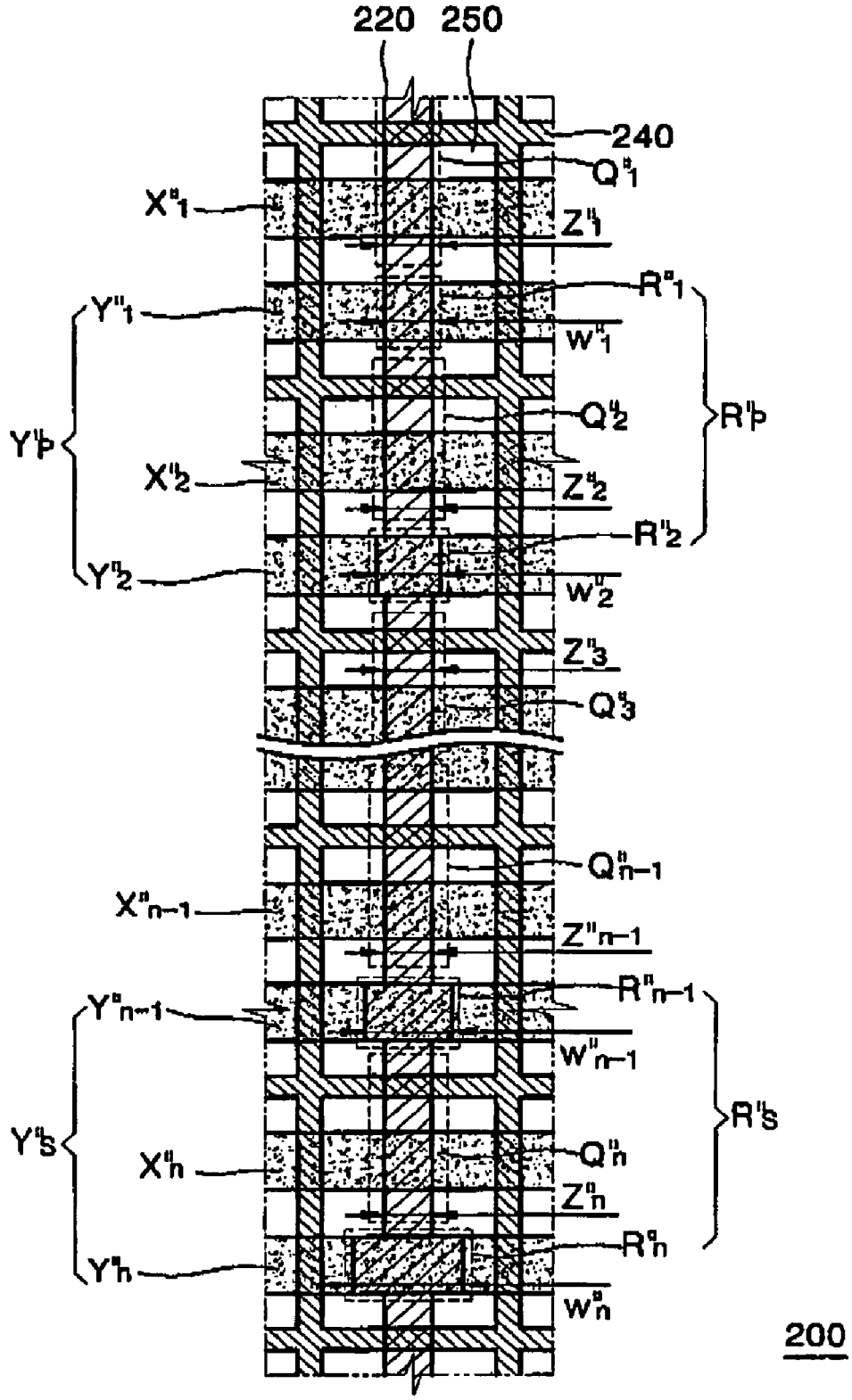
FIG. 4 is a plan view of a plasma display panel configured in accordance with a second embodiment of the present invention, wherein various layers of the plasma display panel are illustrated in shadow.

Referring to FIG. 4, widths $z''_1$, $z''_2$, . . . , $z''_{n-1}$, $z''_n$ of non-discharging portions $Q''_1$, $Q''_2$, . . . , $Q''_{n-1}$, $Q''_n$ of the address electrode 220 are equal. Moreover, it is desirable that the widths $z''_1$, $z''_2$, . . . , $z''_{n-1}$, $z''_n$ of the non-discharging portions are equal to the width $w''_1$ of the narrowest discharging portion $R''_1$ to prevent unnecessary power consumption.

This embodiment can obtain the same effects as the previous one, while reducing the unnecessary power consumption, due to the narrower non-discharging portion.

A plasma display panel according to other embodiment of the present invention will now be described mainly in view of differences from the previous embodiment.

Figure 5:
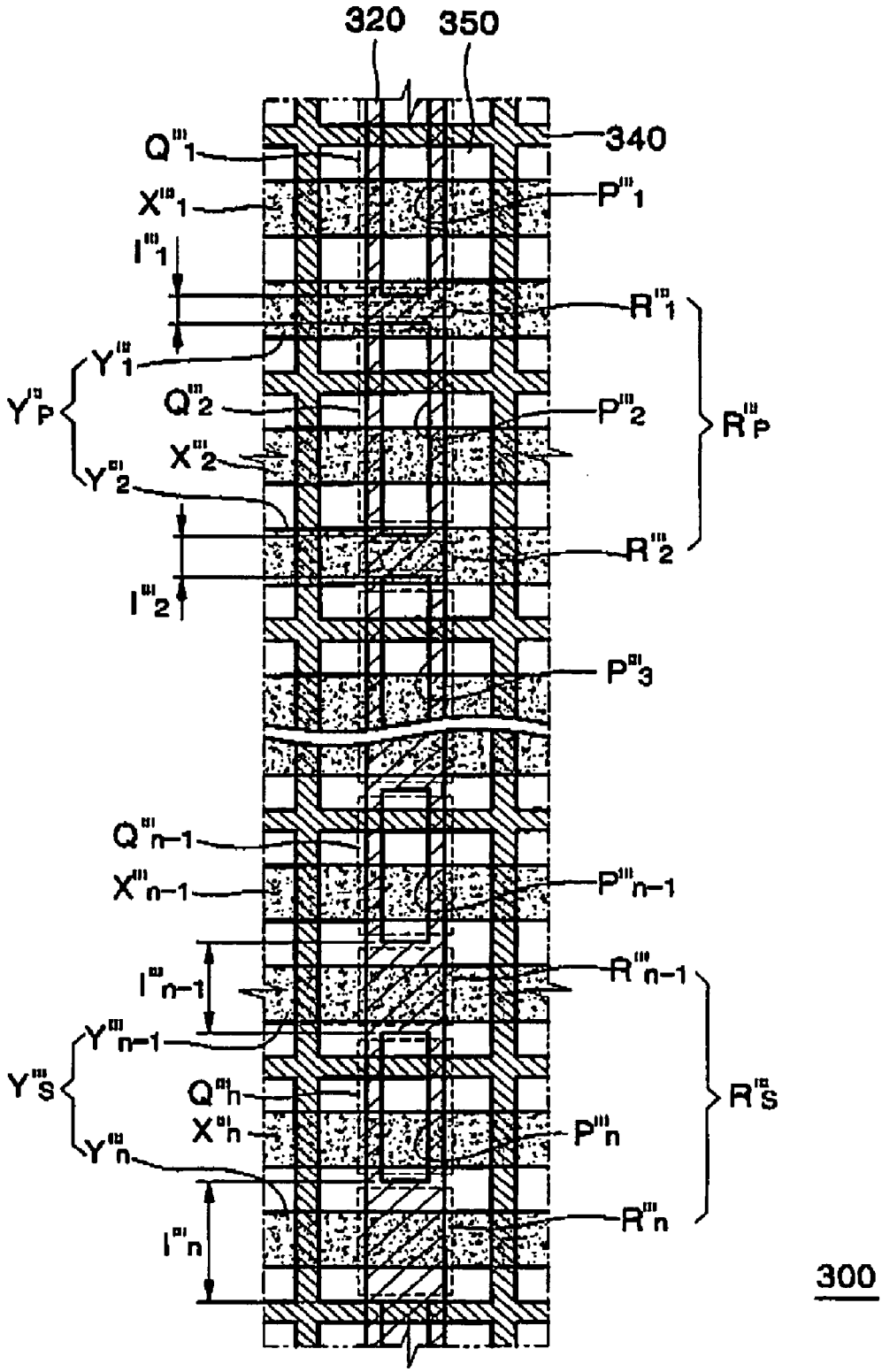
FIG. 5 is a plan view of a plasma display panel configured in accordance with a third embodiment of the present invention, wherein various layers of the plasma display panel are illustrated in shadow.

Referring to FIG. 5, the width of the address electrode 320 is constant in lengthwise direction thereof, but lengths $l'''_1$, $l'''_2$, . . . , $l'''_{n-1}$, $l'''_n$ of the discharging portions $R'''_1$, $R'''_2$, . . . , $R'''_{n-1}$, $R'''_n$ are not equal. That is, the lengths of the discharging portions $R'''_1$, $R'''_2$, . . . , $R'''_{n-1}$, $R'''_n$ are limited by holes $P'''_1$, $P'''_2$, . . . , $P'''_{n-1}$, $P'''_n$ disposed in the non-discharging portions $Q'''_1$, $Q'''_2$, $Q'''_{n-1}$, $Q'''_n$ and the lengths . . . , $l'''_{n-1}$, $l'''_n$ of the subsequent discharging portions . . . , $R'''_{n-1}$, $R'''_n$ are longer than the lengths $l'''_1$, $l'''_2$, . . . of the preceding discharging portions $R'''_1$, $R'''_2$. . . . Therefore, areas of the subsequent discharging portions . . . , $R'''_{n-1}$, $R'''_n$ are larger than areas of the preceding discharging portions $R'''_1$, $R'''_2$. . . .

It is desirable that the lengths $l'''_1$, $l'''_2$, . . . , $l'''_{n-1}$, $l'''_n$ of the discharging portions $R'''_1$, $R'''_2$, . . . , $R'''_{n-1}$, $R'''_n$ increase along the length of the address electrode in order to minimize power consumption and maintain good discharging conditions.

This embodiment, thus, may achieve the same effects as the previous embodiment

The present invention provides a plasma display panel having high brightness on an entire screen with less power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a rear substrate;

a plurality of address electrodes disposed parallel to each other on the rear substrate;

a first dielectric layer covering the address electrodes;

light emitting cells that are defined by a barrier rib formed on the first dielectric layer and covered with a fluorescent substance;

a front substrate;

a plurality of sustain electrode pairs, each including a scan electrode and a data electrode, disposed on the front substrate and crossing the address electrodes; and a second dielectric layer covering the sustain electrode pairs, wherein parts of an address electrode which are crossed by the scan electrodes are defined as discharging portions, and areas of subsequent discharging portions are larger than areas of preceding discharging portions along the entire length of the address electrode.

2. The plasma display panel of claim 1, wherein the subsequent discharging portions are wider than the preceding discharging portions.

3. The plasma display panel of claim 2, wherein the address electrode widens along the entire length of the address electrode.

4. The plasma display panel of claim 2, wherein portions of the address electrode other than the discharging portions are equal in width.

5. The plasma display panel of claim 4, wherein the portions of the address electrode other than the discharging portions are as wide as a narrowest discharging portion.

6. The plasma display panel of claim 1, wherein the address electrode has a constant width, portions of the address electrode other than discharging portions include holes, and wherein subsequent discharging portions are longer than preceding discharging portions.

7. The plasma display panel of claim 6, wherein lengths of the discharging portions increase along the entire length of the address electrode.

8. A plasma display panel, comprising:

a rear substrate;

a plurality of address electrodes disposed parallel to each other on the rear substrate;

a first dielectric layer covering the address electrodes;

light emitting cells that are defined by a barrier rib formed on the first dielectric layer and covered with a fluorescent substance;

a front substrate;

a plurality of sustain electrode pairs, each including a scan electrode and a data electrode, disposed on the front substrate and crossing the address electrodes; and a second dielectric layer covering the sustain electrode pairs, wherein a plurality of first light emitting cells are arranged along a length direction of a first address electrode, each first light emitting cell corresponding to a discrete portion of the first address electrode, and wherein all discrete portions of the first address electrode have different areas from each other.

9. The plasma display panel of claim 8, wherein the discrete portions of the first address electrode respectively comprise parts of the first address electrode which are crossed by the scan electrodes, and areas of subsequent discrete portions are larger than areas of preceding discrete portions along the length of the first address electrode.

10. The plasma display panel of claim 9, wherein the subsequent discrete portions are wider than the preceding discrete portions.

11. The plasma display panel of claim 10, wherein the first address electrode widens along the length of the first address electrode.

12. The plasma display panel of claim 10, wherein portions of the first address electrode other than the discrete portions are equal in width.

13. The plasma display panel of claim 12, wherein the portions of the first address electrode other than the discrete portions are as wide as a narrowest discrete portion.

14. The plasma display panel of claim 9, wherein the first address electrode has a constant width, portions of the first address electrode other than discrete portions include holes, and wherein subsequent discrete portions are longer than preceding discrete portions.

15. The plasma display panel of claim 14, wherein lengths of the discrete portions increase along the length of the first address electrode.

* * * * *